US008515650B2

(12) United States Patent
Kato

(10) Patent No.: US 8,515,650 B2
(45) Date of Patent: Aug. 20, 2013

(54) CONTROL SYSTEM OF INTERNAL COMBUSTION ENGINE

(75) Inventor: Naoto Kato, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/390,120

(22) PCT Filed: Nov. 25, 2009

(86) PCT No.: PCT/JP2009/070203
§ 371 (c)(1),
(2), (4) Date: Feb. 13, 2012

(87) PCT Pub. No.: WO2011/064896
PCT Pub. Date: Jun. 3, 2011

(65) Prior Publication Data
US 2012/0173126 A1 Jul. 5, 2012

(51) Int. Cl.
*F02D 45/00* (2006.01)
*F02D 41/18* (2006.01)
*F02D 41/26* (2006.01)
*F02B 47/08* (2006.01)

(52) U.S. Cl.
USPC ..... 701/105

(58) Field of Classification Search
USPC ..... 701/105, 102, 103, 113; 123/361, 123/494, 406.53, 488
See application file for complete search history.

(56) References Cited

U.S. PATENT DOCUMENTS

| | | | | |
|---|---|---|---|---|
| 4,489,691 | A * | 12/1984 | Ono et al. | 123/406.53 |
| 5,014,548 | A | 5/1991 | Tomisawa | |
| 6,810,859 | B2 * | 11/2004 | Akagi et al. | 123/494 |
| 6,932,055 | B2 * | 8/2005 | Rado | 123/497 |

FOREIGN PATENT DOCUMENTS

| | | | |
|---|---|---|---|
| EP | 1 715 166 | A1 | 10/2006 |
| JP | 02267345 | A * | 11/1990 |
| JP | 2006 9745 | | 1/2006 |
| JP | 2007 231840 | | 9/2007 |
| JP | 2007 303376 | | 11/2007 |
| JP | 2009 103062 | | 5/2009 |
| JP | 2009 121419 | | 6/2009 |

OTHER PUBLICATIONS

International Search Report Issued Jan. 12, 2010 in PCT/JP09/70203 Filed Nov. 25, 2009.
Supplementary European Search Report issued May 14, 2013, in European Patent Application No. EP 09851685.9.

* cited by examiner

*Primary Examiner* — Hieu T Vo
(74) *Attorney, Agent, or Firm* — Oblon, Spivak, McClelland, Maier & Neustadt, L.L.P.

(57) ABSTRACT

A control system of an internal combustion engine is provided with an air flowmeter which is arranged in an engine intake passage, has a transition period from the initial operating state to the end operating state for obtaining the output value of the air flowmeter in the period from the time of startup of the internal combustion engine to when the warmup operation ends, calculates the cumulative air amount in the transition period from the detected output value of the air flowmeter, and uses the calculated cumulative air amount and the reference intake air amount corresponding to the transition period as the basis to correct the output value of the air flowmeter.

11 Claims, 8 Drawing Sheets

CONTROL SYSTEM OF INTERNAL COMBUSTION ENGINE

TECHNICAL FIELD

The present invention relates to a control system of an internal combustion engine.

BACKGROUND ART

An internal combustion engine makes an air-fuel mixture of air and fuel burn in a cylinder. In control of an internal combustion engine, it is known to estimate the amount of air which flows into the cylinder and use the amount of air which flows into the cylinder and the target air-fuel ratio as the basis to determine the amount of fuel which is fed into the cylinder. The amount of air which flows into the cylinder, for example, can be estimated based on the output value of an air flow detector which is arranged in the engine intake passage.

Further, the method is known of using numerical calculations using a model calculation formula derived from a model of the system arranged in the engine intake passage so as to estimate the amount of air which flows into a cylinder. For example, a system is known of preparing in advance a model calculation formula of a throttle valve, intake pipe, etc. and using values of various parameters of the internal combustion engine and the model calculation formula to estimate the amount of air which is filled into the cylinder.

Japanese Patent Publication (A) No. 2007-231840 discloses a control system which is provided with an air flowmeter which is provided in an engine intake passage, a throttle model which estimates an air flow amount passing through a throttle, and an air flowmeter model which uses an estimated value of the air flow amount passing through the throttle calculated by the throttle model as the basis to calculate an anticipated output value of the air flowmeter using a air flowmeter model calculation formula, which system uses an actual measured value of the air flowmeter and the anticipated output value to control the internal combustion engine.

Further, a system is known which estimates the air flow amount passing through a throttle valve from the output values of various types of sensors and maps.

Japanese Patent Publication (A) No. 2006-9745 discloses a method of correction of an air flow sensor output which finds a deviation between an intake air amount which is predicted based on an engine speed and an accelerator opening degree and the intake air amount which is detected by the air flow sensor when cutting the recirculation of the exhaust gas and makes corrections in a direction making the output of the air flow sensor increase when this deviation exceeds a preset threshold value.

CITATION LIST

Patent Literature

PLT 1: Japanese Patent Publication (A) No. 2007-231840
PLT 2: Japanese Patent Publication (A) No. 2006-9745

SUMMARY OF INVENTION

Technical Problem

If an amount of air which flows into a cylinder actually deviates from a target air amount, an output torque deviates from a target value or an air-fuel ratio at the time of combustion deviates from a target value. For this reason, it is preferable to accurately estimate the amount of air which is filled into a cylinder.

In a system which estimates an amount of air which flows into a cylinder from an output of an air flow detector, since the amount of fuel injection is determined based on an air flow amount, it is preferable that the air flow detector can precisely detect the air flow amount. In this regard, if continuing to use it, dust or dirt passing through an air cleaner or blowback of intake air sometimes causes deposits of carbon constituents or other deposits to build up on the detector. For this reason, the output characteristics of the air flow detector sometimes change. That is, the error contained in the output value of an air flow detector sometimes changes.

In a system which uses numerical calculations using a model calculation formula to estimate the amount of air which is filled in a cylinder, it is possible to use an output value of an air flow detector which is arranged in an engine intake passage to correct the air flow amount which is calculated by a model calculation formula. In this case as well, if the output value of the air flow detector includes error, the corrected air flow amount also will end up including error.

The above Japanese Patent Publication (A) No. 2006-9745 discloses a system which uses a predicted intake air amount which is calculated from an engine speed and an accelerator opening degree as a reference to correct the output value of the air flowmeter. However, a valve element of a throttle valve also sometimes has deposits stuck to it. If a valve element of a throttle valve has deposits stuck to it, an opening area of the engine intake passage changes in accordance with an opening degree of the throttle valve. Error occurs in the air flow amount which is estimated based on the accelerator opening degree. When calculating error of the air flow amount which is output from the air flowmeter, error of the opening area of the throttle valve is included. For this reason, there has been room for improvement of the correction of the output value of an air flowmeter.

In this way, the estimated value of the amount of air which is filled into a cylinder includes both error due to the throttle valve and error due to the air flow detector. In the prior art, there was the problem that it was difficult to accurately determine only the error of the air flow detector. That is, there was the problem that it was difficult to separate the error due to the throttle valve and the error due to the air flow detector.

Furthermore, the output value of an air flow detector which is arranged in the engine intake passage is sometimes used not only to estimate the amount of intake air which flows into a cylinder, but also to control the recirculation rate of exhaust gas in the internal combustion engine. It is preferable to be able to precisely detect the air flow amount in the engine intake passage.

Solution to Problem

The present invention has as its object the provision of a control system of an internal combustion engine which can precisely correct the output value of an air flow detector which is arranged in the engine intake passage.

The control system of an internal combustion engine of the present invention is provided with an air-flow detector which is arranged in an engine intake passage. In the period from the time of startup of the internal combustion engine to when the warmup operation ends, the initial operating state and end operating state for obtaining the output value of an air flow detector are determined, the total amount of intake air in the transition period is calculated from a detected output value of the air flow detector in the transition period from the initial operating state to the end operating state, and the calculated total amount of intake air and reference intake air amount corresponding to the transition period are used as the basis to correct the output value of the air flow detector.

In the above invention, it is possible to provide a coolant temperature detector which detects the temperature of a coolant of an engine cooling system and to have the transition period include a period in which the temperature of the coolant of the engine cooling system reaches the temperature judgment value from the predetermined initial operating state.

In the above invention, preferably the initial operating state is the state at the time of startup of the internal combustion engine, and the system detects the temperature of the coolant at the time of startup of the internal combustion engine and increases the reference intake air amount the lower the temperature of the coolant at the time of startup.

In the above invention, the system is a control system of an internal combustion engine in which an exhaust treatment device is arranged in the engine exhaust passage, the system may be provided with a temperature detector which detects a temperature of the exhaust treatment device, and the transition period may include a period in which the temperature of the exhaust treatment device reaches the temperature judgment value from the predetermined initial operating state.

In the above invention, preferably the initial operating state is the state at the time of startup of the internal combustion engine, and the system detects the temperature of the exhaust treatment device at the time of startup of the internal combustion engine and increases the reference intake air amount larger the lower the temperature of the exhaust treatment device at the time of startup.

In the above invention, the system is a control system of an internal combustion engine in which an exhaust treatment device is arranged in the engine exhaust passage, the system may be provided with a storage estimating device which estimates the maximum oxygen storage amount of the exhaust treatment device, and the transition period may includes a period in which the maximum oxygen storage amount of the exhaust treatment device reaches the storage amount judgment value from the predetermined initial operating state.

In the above invention, preferably the initial operating state is the state at the time of startup of the internal combustion engine, and the system estimates the maximum oxygen storage amount at the time of startup of the internal combustion engine and increases the reference intake air amount the smaller the maximum oxygen storage amount at the time of startup.

In the above invention, preferably when calculating the total amount of intake air in the transition period, the system detects the amount of retardation of the ignition timing in the combustion chamber and makes correction so that the total amount of intake air becomes larger the larger the amount of retardation of the ignition timing.

In the above invention, preferably when calculating the total amount of intake air in the transition period, the system estimates the air-fuel ratio at the time of combustion in the combustion chamber and makes correction so that the total amount of intake air becomes smaller the larger the air-fuel ratio at the time of combustion in the region in which the air-fuel ratio at the time of combustion becomes lean.

In the above invention, preferably, when calculating the total amount of intake air in the transition period, the system estimates the air-fuel ratio at the time of combustion in the combustion chamber and makes correction so that the total amount of intake air becomes smaller the smaller the air-fuel ratio at the time of combustion in the region in which the air-fuel ratio at the time of combustion becomes rich.

In the above invention, preferably the system is a control system of an internal combustion engine which has a recirculation passage which causes exhaust gas to recirculate from the engine exhaust passage to the engine intake passage and, when calculating the total amount of intake air in the transition period, the system makes corrections so that the smaller the total amount of intake air becomes smaller the larger the recirculation rate of the exhaust gas.

Advantageous Effect of Invention

According to the present invention, it is possible to provide a control system of an internal combustion engine which can precisely correct the output value of an air flow detector which is arranged in an engine intake passage.

DESCRIPTION OF EMBODIMENTS

Embodiment 1

Referring to FIG. 1 to FIG. 9, a control system of an internal combustion engine in Embodiment 1 will be explained.

Figure 1:
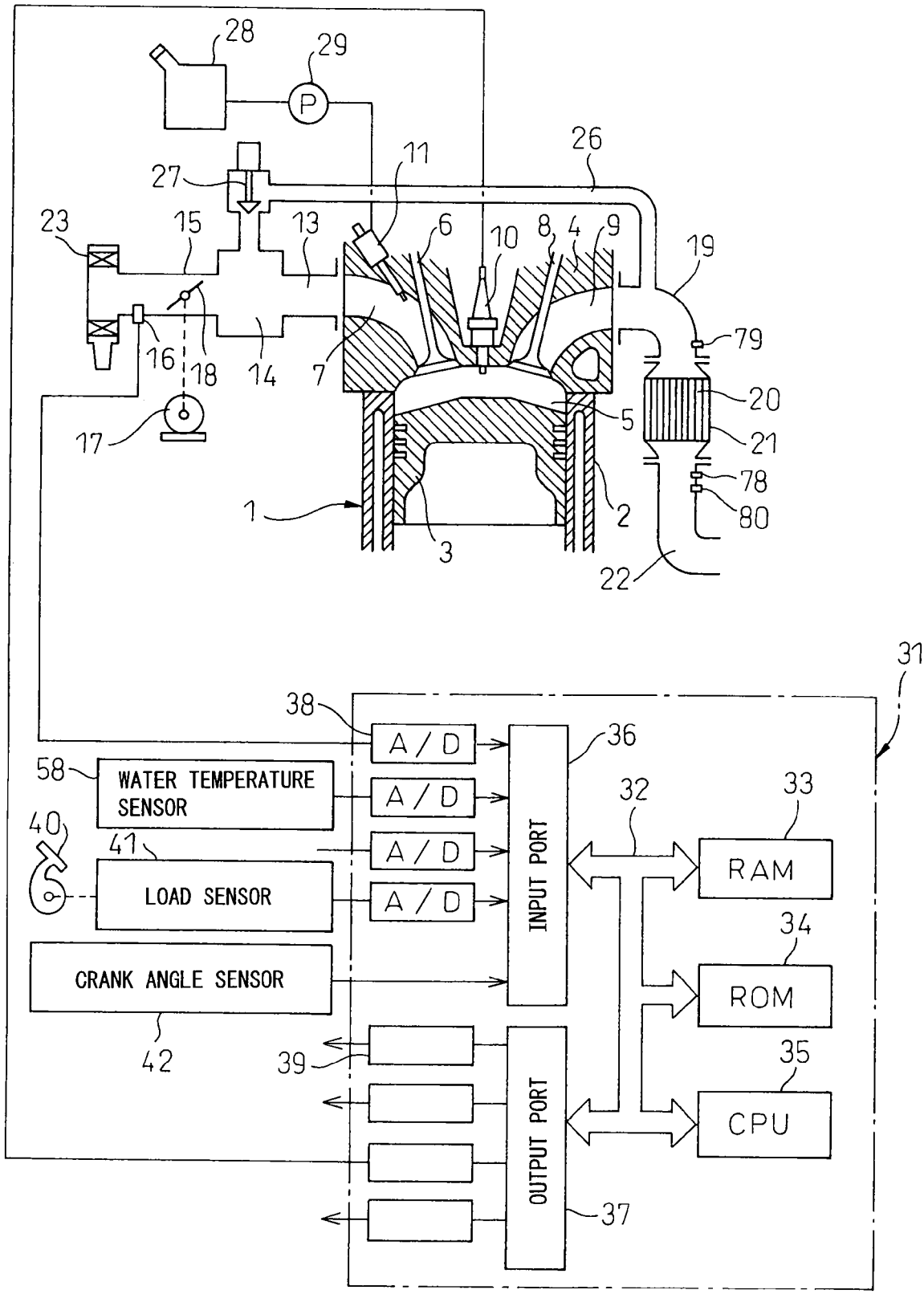
FIG. 1 is a schematic overall view of an internal combustion engine in Embodiment 1.

FIG. 1 is a schematic view of the internal combustion engine in the present embodiment. The internal combustion engine in the present embodiment is a spark ignition type. The internal combustion engine is provided with an engine body 1. The engine body 1 includes a cylinder block 2 and a cylinder head 4. Inside of the cylinder block 2, combustion chambers 5 of the cylinders are formed. Each combustion chamber 5 has a piston 3 arranged in it. The combustion chambers 5 are connected to an engine intake passage and an engine exhaust passage. The engine intake passage is a passage into which air or a mixture gas of air and fuel flows. The engine exhaust passage is a passage into which gas which is burned in the combustion chambers 5 is exhausted.

The cylinder head 4 is formed with intake ports 7 and exhaust ports 9. Intake valves 6 are arranged at the ends of the intake ports 7 and are formed so as to be to able to open and close the engine intake passage communicated with the combustion chambers 5. Exhaust valves 8 are arranged at the ends of the exhaust ports 9 and are formed so as to be able to open and close the engine exhaust passage communicated with the combustion chambers 5. The cylinder head 4 has spark plugs 10 fixed to it as ignition devices. The spark plugs 10 are formed so as to ignite the mixture gas of the fuel and the air at the combustion chambers 5.

The internal combustion engine in the present embodiment is provided with fuel injectors 11 for feeding fuel to the combustion chambers 5. The fuel injectors 11 in the present embodiment are arranged to inject fuel into the intake ports 7. The fuel injectors 11 are not limited to this. They need only be arranged so as to be able to feed fuel to the combustion chambers 5. For example, the fuel injectors 11 may be arranged so as to directly inject fuel to the combustion chambers.

The fuel injectors 11 are connected to a fuel tank 28 through an electronically controlled variable discharge fuel pump 29. The fuel which is stored in the fuel tank 28 is fed by the fuel pump 29 to the fuel injectors 11.

The intake port 7 of each cylinder is connected through a corresponding intake tube 13 to a surge tank 14. The surge tank 14 is connected through an intake duct 15 to an air cleaner 23. Inside of the intake duct 15, a throttle valve 18 which is driven by a step motor 17 is arranged. In the intake duct 15, an air flowmeter 16 is arranged as an air flow detector. The air flowmeter 16 in the present embodiment is a hot wire type, but the invention is not limited to this. Any air flow detector may be arranged. The air flowmeter 16 in the present embodiment is arranged between the throttle valve 18 and the air cleaner 23, but the invention is not limited to this. It may also be arranged in the engine intake passage.

The throttle valve 18 in the present embodiment is a butterfly valve. The throttle valve 18 includes a plate-shaped valve element. The valve element pivots to open and close the engine intake passage. The throttle valve 18 is not limited to this. It is also possible to employ any valve which can adjust the amount of flow of the intake air. For example, a slide type of valve may also be arranged.

On the other hand, the exhaust ports 9 of the cylinders are connected to the corresponding exhaust tubes 19. The exhaust tubes 19 are connected to an exhaust treatment device which purifies exhaust gas constituted by a catalyst converter 21. The catalyst converter 21 in the present embodiment includes a three-way catalyst 20. The catalyst converter 21 is connected to an exhaust pipe 22.

If the ratio of the air and fuel (hydrocarbons) of the exhaust gas which is fed into the engine intake passage, combustion chambers, or engine exhaust passage is referred to as "the air-fuel ratio of the exhaust gas (A/F)", upstream of the three-way catalyst 20 in the engine exhaust passage, an air-fuel ratio sensor 79 is arranged to detect the air-fuel ratio of the exhaust gas. At the downstream side of the three-way catalyst 20 in the engine exhaust passage, a temperature sensor 78 is arranged as a temperature detector for detecting the temperature of the three-way catalyst 20. Further, at the downstream side of the three-way catalyst 20 in the engine exhaust passage, an air-fuel ratio sensor 80 is arranged for detecting the air-fuel ratio of the exhaust gas which flows out from the three-way catalyst 20.

The engine body 1 in the present embodiment has a recirculation passage for exhaust gas recirculation (EGR). In the present embodiment, an EGR gas conduit 26 is arranged as the recirculation passage. The EGR gas conduit 26 connects the exhaust tube 19 and the surge tank 14 together. In the EGR gas conduit 26, an EGR control valve 27 is arranged. The EGR control valve 27 is formed so that the amount of flow of the exhaust gas which is recirculated can be adjusted.

The internal combustion engine in the present embodiment is provided with an electronic control unit 31. The electronic control unit 31 in the present embodiment includes a digital computer. The electronic control unit 31 includes components which are connected to each other through a bidirectional bus 32 such as a RAM (random access memory) 33, ROM (read only memory) 34, CPU (microprocessor) 35, input port 36, and output port 37.

An accelerator pedal 40 is connected to a load sensor 41. An output signal of the load sensor 41 is input to an input port 36 through a corresponding AD converter 38. Further, a crank angle sensor 42 generates an output pulse every time the crankshaft rotates by, for example, 30°. This output pulse is input to the input port 36. The output of the crank angle sensor 42 can be used to detect the speed of the engine body 1. The output signal of the air flowmeter 16 is input through a corresponding AD converter 38 to the input port 36. Furthermore, the electronic control unit 31 receives, as input, signals of a temperature sensor 78, air-fuel ratio sensors 79 and 80 and other sensors.

The output port 37 of the electronic control unit 31 is connected through corresponding drive circuits 39 to the fuel injectors 11 and spark plugs 10. The electronic control unit 31 in the present embodiment is formed so as to control the fuel injection and control the ignition. The timing of injection of the fuel and the amount of injection of the fuel are controlled by the electronic control unit 31. Furthermore, the ignition timings of the spark plugs 10 are controlled by the electronic control unit 31. Further, the output port 37 is connected through the corresponding drive circuits 39 to the step motor which drives the throttle valve 18, the fuel pump 29, and the EGR control valve 27. These devices are controlled by the electronic control unit 31.

The three-way catalyst 20 includes, as a catalyst metal, platinum (Pt), palladium (Pd), rhodium (Rh), or other precious metal. The three-way catalyst 20 is, for example, comprised of a cordierite or other base material formed into a honeycomb shape on the surface of which aluminum oxide or another catalyst carrier is formed. The precious metal is supported on the catalyst carrier. The three-way catalyst 20 can remove the HC, CO, and $NO_x$ with a high efficiency by making the air-fuel ratio of the inflowing exhaust gas substantially the stoichiometric air-fuel ratio.

Figure 2:
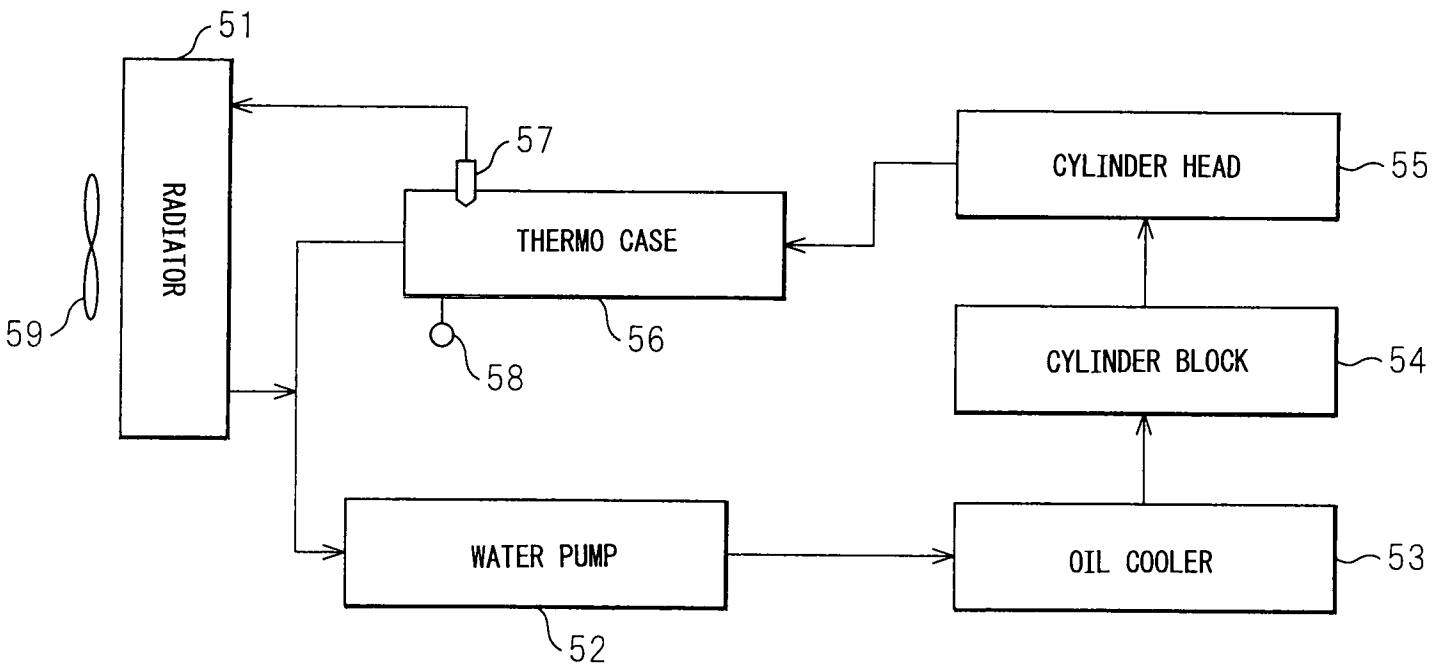
FIG. 2 is a schematic system diagram of an engine cooling system in Embodiment 1.

FIG. 2 is a schematic view of an engine cooling system in the present embodiment. The internal combustion engine in the present embodiment is provided with an engine cooling system which cools the engine body 1. The engine cooling system is formed so that cooling water (hereinafter referred to as the "engine cooling water") flows as a coolant in the system formed by piping. The engine cooling system is formed so that when the water pump 52 is driven, the engine cooling water flows through the oil cooler 53, cylinder block 54, and cylinder head 55 in that order and then into a thermo case 56.

At the thermo case 56, as a coolant temperature detector, a water temperature sensor 58 which measures the temperature of the engine cooling water is arranged. In the present embodiment, at the thermo case 56, a thermostat 57 is arranged. When the water temperature of the engine cooling water becomes a predetermined management value or more, the thermostat 57 causes a cutoff valve to open and engine cooling water to flow into the radiator 51.

The radiator 51 is a heat radiating device which cools the engine cooling water. At the front side of the radiator 51, a fan 59 is arranged for forcibly blowing air to the radiator 51. When the fan 59 turns, the engine cooling water is forcibly cooled. The engine cooling water which is cooled by the radiator 51 heads toward the water pump 52. When the water pump 52 is driven, the engine cooling water circulates through the inside of the engine cooling system.

Referring to FIG. 1 and FIG. 2, the output of the water temperature sensor 58 is input to the electronic control unit 31. The output port 37 of the electronic control unit 31 is connected through the corresponding drive circuit 39 to the water pump 52 and the fan 59. The engine cooling system is controlled by the electronic control unit 31.

Figure 3:
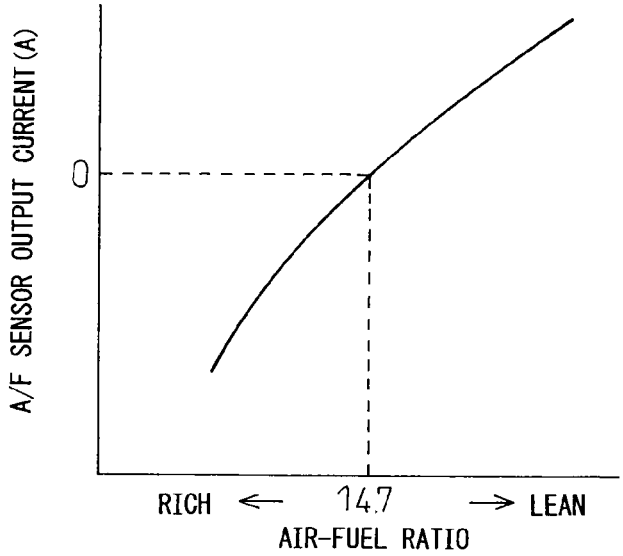
FIG. 3 is a schematic view which explains an output value of an air-fuel ratio sensor.

FIG. 3 is a graph which explains the relationship between the output current of the air-fuel ratio sensor and the air-fuel ratio in the present embodiment. The air-fuel ratio sensor in the present embodiment is a full region type sensor which gives output values corresponding to the respective points of the air-fuel ratio of the exhaust gas. The smaller the air-fuel ratio (the richer the air-fuel ratio), the smaller the output current of the air-fuel ratio sensor. Further, at the stoichiometric air-fuel ratio where the air-fuel ratio becomes substantially 14.7, the output current of the air-fuel ratio sensor becomes 0 A. The air-fuel ratio sensor in the present embodiment is a linear air-fuel ratio sensor which has a substantially proportional relationship between the air-fuel ratio and its output value and can detect the air-fuel ratios in different states of the exhaust gas.

In the present embodiment, the output value of the air flowmeter is obtained in the period at the time of startup of the internal combustion engine to the end of the warmup operation. The obtained output value is used as the basis to calculate the correction value for the output value of the air flowmeter. The warmup operation ends when the temperatures of the devices included in the internal combustion engine reach predetermined temperatures after the internal combustion engine is started. For example, the period after the startup of the internal combustion engine to when the temperature of the engine cooling water reaches a predetermined temperature corresponds to the period of the warmup operation.

Figure 4:
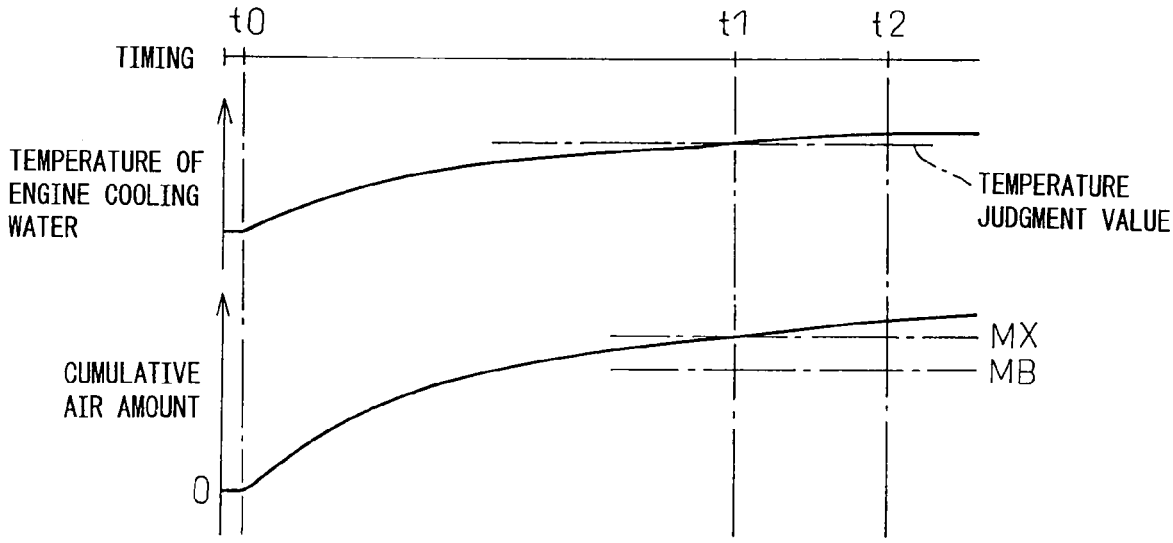
FIG. 4 is a time chart of a first operational control in Embodiment 1.

FIG. 4 is a time chart of first operational control of the internal combustion engine in the present embodiment. At the timing t0, the internal combustion engine is started up. In the present embodiment, the internal combustion engine is started up after being stopped for a long period of time. When the engine body becomes a temperature substantially the same as the external air temperature, the internal combustion engine is started up. The engine cooling water becomes a temperature substantially the same as the external air temperature.

In the first operational control of the present embodiment, the temperature of the engine cooling water is used as the basis to determine the initial operating state and the end operating state so as to obtain the output value of the air flow detector. The initial operating state is the state at the time of startup of the internal combustion engine. The end operating state is the state where the temperature of the engine cooling water reaches the temperature judgment value. In the example shown in FIG. 4, the temperature judgment value of the engine cooling water is predetermined. As the temperature judgment value, a temperature of not more than the temperature when the warmup operation of the internal combustion engine ends may be employed. For example, as the temperature judgment value, a temperature near the temperature where the warmup operation ends may be employed.

The temperature of the engine cooling water rises after startup of the internal combustion engine. At the timing t1, the temperature of the engine cooling water reaches the temperature judgment value. At the timing t2, the temperature of the engine cooling water reaches a steady state. At the timing t2, the warmup operation ends.

In the present embodiment, in the transition period from the initial operating state to the end operating state where the output value of the air flowmeter 16 is obtained, the output value of the air flowmeter 16 is sampled every predetermined time interval Δt. In the period from the timing t0 to the timing t1, the output value of the air flowmeter 16 is obtained. The total amount of the intake air is calculated from the obtained output value. That is, the total amount of the air which flows into a combustion chamber 5 is calculated from the timing t0 to the timing t1. In the present embodiment, the cumulative air amount is calculated. At the timing t0, the cumulative air amount is zero, while at the timing t1, it is the cumulative air amount MX.

In this way, the cumulative air amount MX is the calculated air amount from the output value of the air flowmeter. As opposed to this, the reference intake air amount MB corresponding to the transition period is predetermined. The reference intake air amount MB is a reference value of the amount of air which flows into a combustion chamber. The reference intake air amount MB is, for example, stored in the ROM 34 of the electronic control unit 31 (see FIG. 1).

The cumulative air amount MX which is calculated from the output value of the air flowmeter deviates from the reference intake air amount MB. A correction value of the output value of the air flowmeter is calculated. The rate of deviation of the air flowmeter becomes the correction value (MX/MB). The air flow amount which is estimated from the output value of the air flowmeter may be divided by the correction value (MX/MB) to estimate the air flow amount more accurately.

Figure 5:
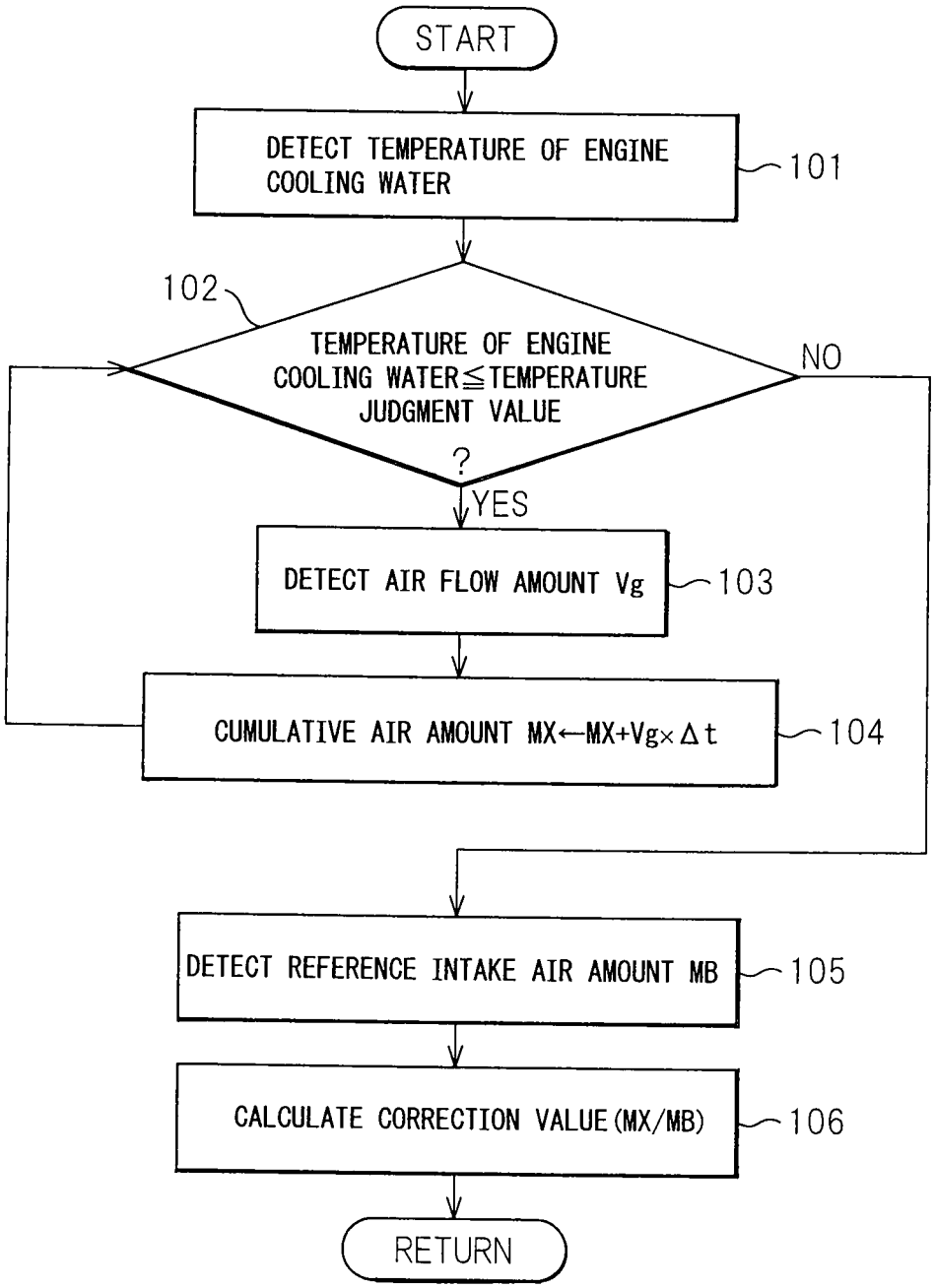
FIG. 5 is a flow chart of a first operational control in Embodiment 1.

FIG. 5 shows a flow chart for calculating the correction value of the output value of the air flowmeter of the control system of an internal combustion engine in the present embodiment. The control shown in FIG. 5 can be started in the initial period of the transition period. For example, it can be started at the time of startup of the internal combustion engine, that is, the timing t0.

At step 101, the temperature of the engine cooling water is detected by the water temperature sensor 58. Next, at step 102, it is judged if the temperature of the engine cooling water is a temperature judgment value or less. That is, it is judged if the engine cooling water has risen to the temperature judgment value. When the temperature of the engine cooling water is the temperature judgment value or less, the routine proceeds to step 103. At step 103, the output of the air flowmeter 16 is used as the basis to detect the air flow amount Vg.

At step 104, the cumulative air amount MX from the timing t0 to the current timing is calculated. The air flow amount Vg which is detected from the air flowmeter 16 is multiplied with the time interval Δt for detection of the air flow amount Vg to calculate the amount of air. This is then added to the cumulative air amount MX which was calculated at the previous calculation. Here, in the present embodiment, the initial value of the cumulative air amount MX at the timing t0 is zero.

Next, at step 102, it is again judged if the temperature of the engine cooling water is the judgment value or less. In this way, the routine from step 102 to step 104 is repeated every time interval Δt.

At step 102, when the temperature of the engine cooling water is larger than the temperature judgment value, the routine proceeds to step 105. It is possible to calculate the total amount of intake air in the period from the time of startup of the internal combustion engine to when the temperature of the engine cooling water reaches the temperature judgment value. At step 105, the reference intake air amount MB is detected. As the reference intake air amount MB, for example, a predetermined value can be employed. Next, at step 106, the correction value of the output value of the air flowmeter (MX/MB) is calculated.

The correction value (MX/MB) shows the rate of deviation of the air flowmeter, so the calculated correction value may be used to correct the output value of the air flowmeter as in the following formula (1).

$$Vg'=Vg/(MX/MB) \quad (1)$$

Here, the variable Vg is the amount of flow of intake air after the previous correction and is the amount of flow including the correction value calculated at the previous correction. The variable Vg' is the amount of flow of intake air based on the output value of the air flowmeter after the current correction.

In the present embodiment, when calculating the correction value, the air flow amount considering the correction value for the raw output of the air flowmeter is further divided by the current correction value, but the invention is not limited to this. For example, it is also possible to detect the value of the raw output while assuming the previous correction value of the output value of the air flowmeter to be "1". In this case, it is possible to calculate the cumulative air amount MX of the transition period in which the temperature of the internal combustion engine rises and to divide the value of the raw output of the air flowmeter by the calculated correction value (MX/MB).

The control system of an internal combustion engine of the present embodiment calculates the rate of deviation of the air flowmeter based on the amount of heat generated when the internal combustion engine performs a warmup operation. For this reason, it is possible to correct the output value of the air flowmeter, that is, to calibrate the air flowmeter, without being influenced by other devices which are arranged in the engine intake passage. For example, deposits etc. may build up on the valve element of the throttle valve. Even if the opening area of the engine intake passage at the throttle valve changes, it is possible to calculate the rate of deviation of the air flowmeter without being affected by the change. For this reason, it is possible to precisely calibrate the air flowmeter. As a result, it is possible to precisely estimate the air flow amount in the engine intake passage.

In the present embodiment, it is possible to correct the output value of the air flowmeter without being affected by the throttle valve, so it is possible to utilize the amount of flow of intake air which is calculated from the air flowmeter to precisely correct the opening area at the throttle valve.

In control of the internal combustion engine, for example, the demanded torque is determined from the amount of depression of the accelerator pedal, and the opening degree of the throttle valve is set in accordance with this demanded torque. That is, the air flow amount which passes through the throttle valve is determined in accordance with the demanded torque. After opening the throttle valve, the air flow amount which actually passes through the throttle valve is detected by the air flowmeter, and the detected air flow amount and target combustion air-fuel ratio are used as the basis to determine the amount of fuel injection.

However, if deposits build up at the valve element of the throttle valve, sometimes the opening area of the engine intake passage, which corresponds to the opening degree of the throttle valve, becomes smaller. Such error in a throttle valve can be corrected based on the output value of the air flow detector which is arranged in the engine intake passage. That is, it is possible to correct the air flow amount for the opening degree of the throttle valve. In this regard, if the air flow amount which is estimated from the output value of the air flow detector includes error, there is the problem that the correction of the throttle valve also ends up including error.

In the present embodiment, it is possible to precisely estimate the air flow amount for enabling calibration of the air flowmeter without being affected by the throttle valve. For this reason, it is possible to precisely correct the opening area of the throttle valve. In this way, the control system of an internal combustion engine in the present embodiment enables separation of the error due to the air flow detector and the error due to the throttle valve and respective correction of the same.

Since it is possible to precisely correct the opening area of the throttle valve, it is possible to more accurately control the air flow amount into the combustion chambers. It is therefore possible to accurately control the amount of air corresponding to the demanded torque. As a result, the deviation in the output torque from the demanded torque can be reduced. The controllability of the output torque of the internal combustion engine is improved.

Further, in the present embodiment, the air flow amount which flows into a combustion chamber can be more accurately controlled, so the ignition timing at the combustion chamber can be set to the optimum timing. For example, if retarding the ignition timing to avoid knocking, it is possible to reduce excess of the retardation amount. The ignition timing can be made to approach the ignition timing where the output torque becomes maximum (MBT) and the fuel consumption can be improved. In this way, the output value of the air flowmeter can be precisely corrected to thereby enable finer control.

In this regard, the external air temperature at the time of starting up the internal combustion engine changes according to the season or location etc. The temperature of the engine cooling water also changes in the period when the internal combustion engine stops. To deal with fluctuations in the temperature of the engine cooling water at the time of startup, it is possible to detect the temperature of the engine cooling water when starting the calculation of the cumulative air amount and control the reference intake air amount MB to become larger the lower the temperature of the engine cooling water.

Figure 6:
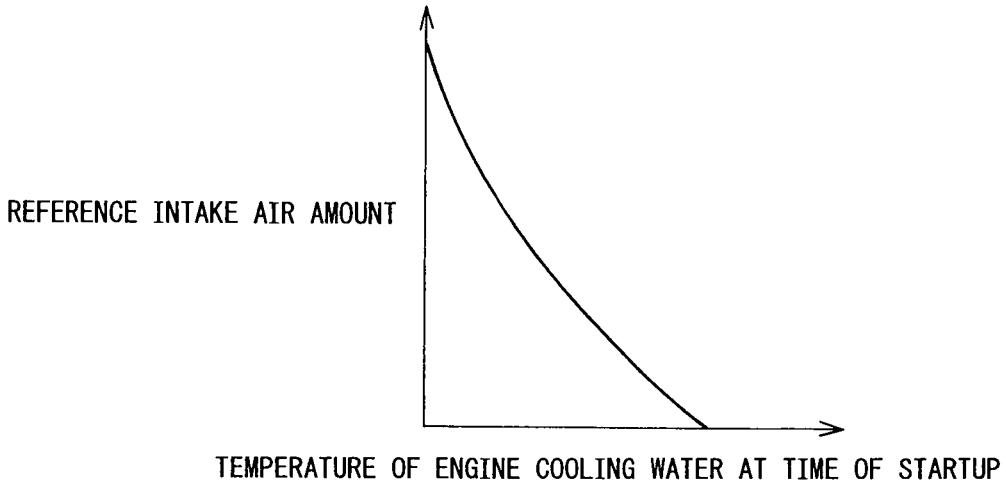
FIG. 6 is a graph of a reference intake air amount in a first operational control in Embodiment 1.

FIG. 6 is a graph of the reference intake air amount MB with respect the temperature of the engine cooling water at the time of startup. It is possible to detect the temperature of the engine cooling water at the time of starting up the internal combustion engine and determine the reference intake air amount MB corresponding to the detected temperature. For example, when the outside air temperature is low, the temperature of the engine cooling water at the time of startup becomes lower. A long time is taken until the temperature of the engine cooling water reaches the temperature judgment value. Along with the drop of temperature, the cumulative air amount MX becomes larger, so a large value is employed for the reference intake air amount MB.

The relationship between the temperature of the engine cooling water and the reference intake air amount MB at the time of startup shown in FIG. 6, for example, can be stored in the ROM 34 of the electronic control unit 31. In this way, by changing the reference intake air amount in accordance with the temperature of the engine cooling water at the time of startup, it is possible to more precisely calculate the correction value for the output value of the air flowmeter.

Figure 7:
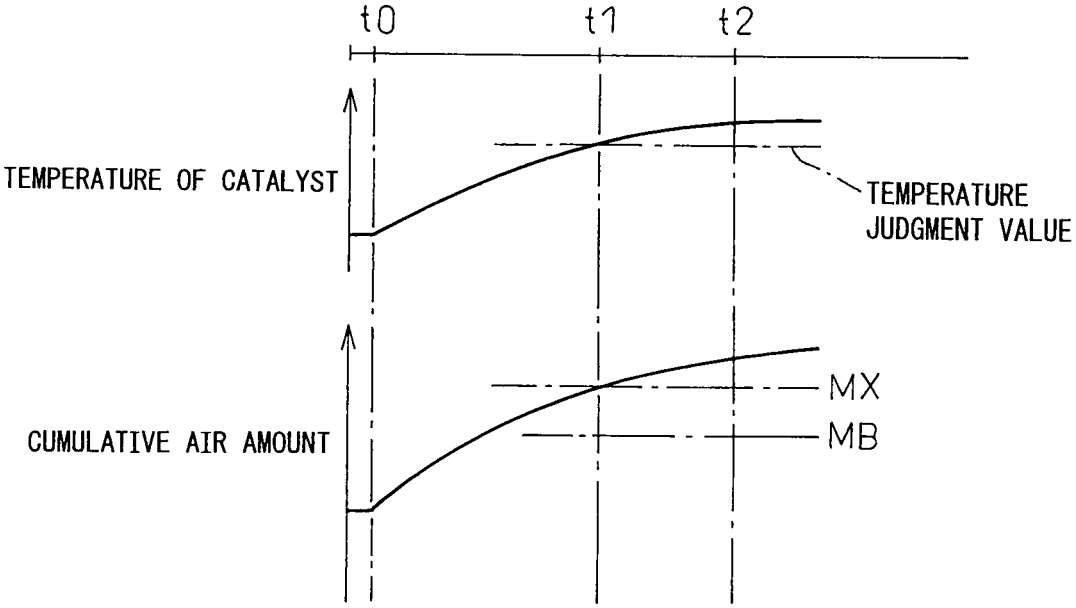
FIG. 7 is a time chart of a second operational control in Embodiment 1.

FIG. 7 shows a time chart of second operational control of the internal combustion engine in the present embodiment. In the second operational control, instead of the temperature of the engine cooling water, the temperature of an exhaust treatment device which is arranged in the engine exhaust passage is used as the basis to determine the transition period for obtaining the output value of the air flow detector.

If the internal combustion engine is started up at the timing t0, high temperature exhaust gas flows out from the combustion chambers 5 to the engine exhaust passage. The exhaust gas flows into the catalyst converter 21 used as the exhaust treatment device. In the present embodiment, the gas flows out to the three-way catalyst 20. The temperature of the three-way catalyst 20 rises along with time. The temperature of the three-way catalyst 20 can be detected by the temperature sensor 78. At the timing t2, the temperature of the three-way catalyst 20 becomes the steady state and the warmup operation ends.

The control system of an internal combustion engine has a temperature judgment value of the catalyst for determining the operating state of the end timing of the transition period. The temperature judgment value of the catalyst can be set to the catalyst temperature or less when the warmup operation of the internal combustion engine ends and the steady state is reached. For example, as the temperature judgment value of the catalyst, it is possible to employ the activation temperature of the three-way catalyst 20 etc.

At the timing t1, the temperature of the three-way catalyst 20 reaches the temperature judgment value. In the transition period from the timing t0 to the timing t1, the cumulative air amount MX is calculated from the output value of the air flowmeter.

Figure 8:
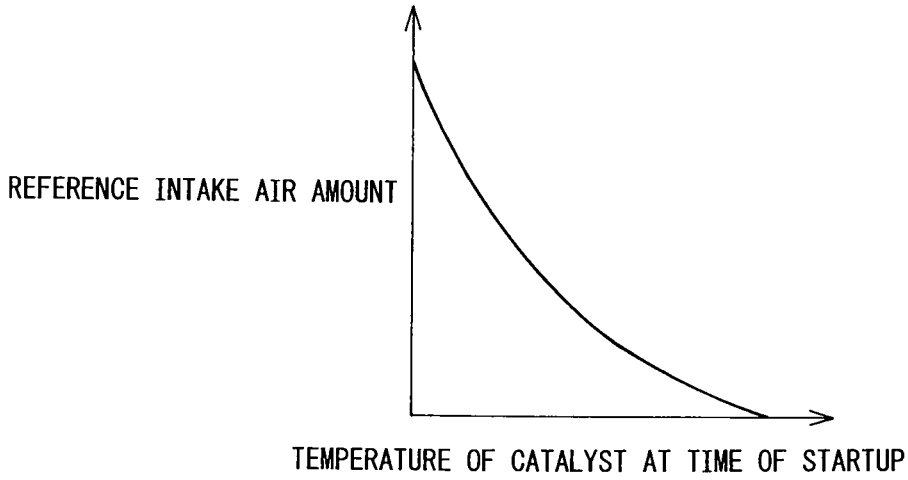
FIG. 8 is a graph of a reference intake air amount of a second operational control in Embodiment 1.

FIG. 8 shows a graph of the reference intake air amount of the second operational control in the present embodiment. In the same way as the first operational control, it is possible to use the temperature of the three-way catalyst 20 at the time of startup as the basis to change the reference intake air amount MB. The lower the temperature of the three-way catalyst 20 at the time of startup, the larger the reference intake air amount MB can be made. Due to this control, it is possible to more accurately calculate the correction value of the air flowmeter. The temperature judgment value of the exhaust treatment device is not limited to this. It is also possible to employ a predetermined value.

Next, in the same way as the first operational control, the calculated cumulative air amount MX and reference intake air amount MB are used to calculate the correction value (MX/MB) for the output value of the air flowmeter. By dividing the air flow amount which is estimated from the output value of the air flowmeter by this correction value, it is possible to precisely correct the output value of the air flowmeter.

As the operating state of the internal combustion engine, it is possible to detect the temperature of the exhaust treatment device to directly detect the amount of heat which is exhausted from the engine body rather than detect the temperature of the engine cooling water. For this reason, it is possible to more precisely calculate the correction value of the output value of the air flowmeter.

Next, third operational control in the present embodiment will be explained. In the third operational control, the maximum oxygen storage amount of the exhaust treatment device which is arranged in the engine exhaust passage is used as the basis to determine the transition period for obtaining the output value of the air flow detector. By the internal combustion engine starting up and the temperature of the exhaust treatment device rising, the maximum oxygen storage amount of the exhaust treatment device increases. The three-way catalyst 20 in the present embodiment has an oxygen storage ability. The three-way catalyst 20 in the present embodiment includes ceria $CeO_2$ as a substance which stores the oxygen.

The internal combustion engine in present embodiment is provided with a storage amount detection device which detects the maximum oxygen storage amount of the exhaust treatment device. The maximum oxygen storage amount of the exhaust treatment device, for example, repeats a period where the air-fuel ratio of the exhaust gas which flows to the three-way catalyst 20 is rich and a period where it is lean. This can be estimated by detecting the air-fuel ratio of the exhaust gas which flows into the three-way catalyst 20 and the air-fuel ratio of the exhaust gas which flows out from the three-way catalyst 20 at this time.

For example, the air-fuel ratio of the exhaust gas which flows to the three-way catalyst 20 is controlled to be rich. By maintaining the air-fuel ratio of the exhaust gas rich for a predetermined time, the oxygen storage amount of the three-way catalyst 20 can be made substantially zero. Next, the air-fuel ratio of the exhaust gas which flows to the three-way catalyst 20 is switched to the lean state. At this time, the air-fuel ratio of the exhaust gas which flows in to the three-way catalyst 20 and the air-fuel ratio of the exhaust gas which flows out from the three-way catalyst 20 are detected by the air-fuel ratio sensors 79 and 80.

Until the oxygen storage amount of the three-way catalyst 20 reaches the maximum oxygen storage amount, the three-way catalyst 20 stores oxygen. When the oxygen storage amount of the three-way catalyst 20 reaches the maximum oxygen storage amount, oxygen passes through the three-way catalyst 20. For this reason, after the elapse of a predetermined time, the output of the air-fuel ratio sensor 80 which is arranged downstream of the three-way catalyst 20 is switched from rich to lean.

The amount of oxygen which is contained in the air which flows into the three-way catalyst 20 in the period from the time when the air-fuel ratio of the exhaust gas which flows into the three-way catalyst 20 is switched to lean to the time when the air-fuel ratio of the exhaust gas which flows out from three-way catalyst 20 changes to lean is estimated. This oxygen amount corresponds to the maximum oxygen storage amount. The output value of the air-fuel ratio sensor 79 which is arranged upstream of the three-way catalyst 20 can be used to cumulatively add the amount of oxygen which flows into the three-way catalyst 20 and estimate the maximum oxygen storage amount.

By repealing the period in which the air-fuel ratio of the exhaust gas is rich and the period in which it is lean in this way, the maximum oxygen storage amount of the exhaust treatment device can be estimated. The sensor which is arranged downstream of the exhaust treatment device is not limited to an air-fuel ratio sensor which can continuously detect the value of the air-fuel ratio of the exhaust gas. An oxygen sensor which can judge if the air-fuel ratio of the exhaust gas is rich or lean may also be included. The storage estimating device is not limited to this. It is possible to employ any device which can estimate the maximum oxygen storage amount of the exhaust treatment device.

Figure 9:
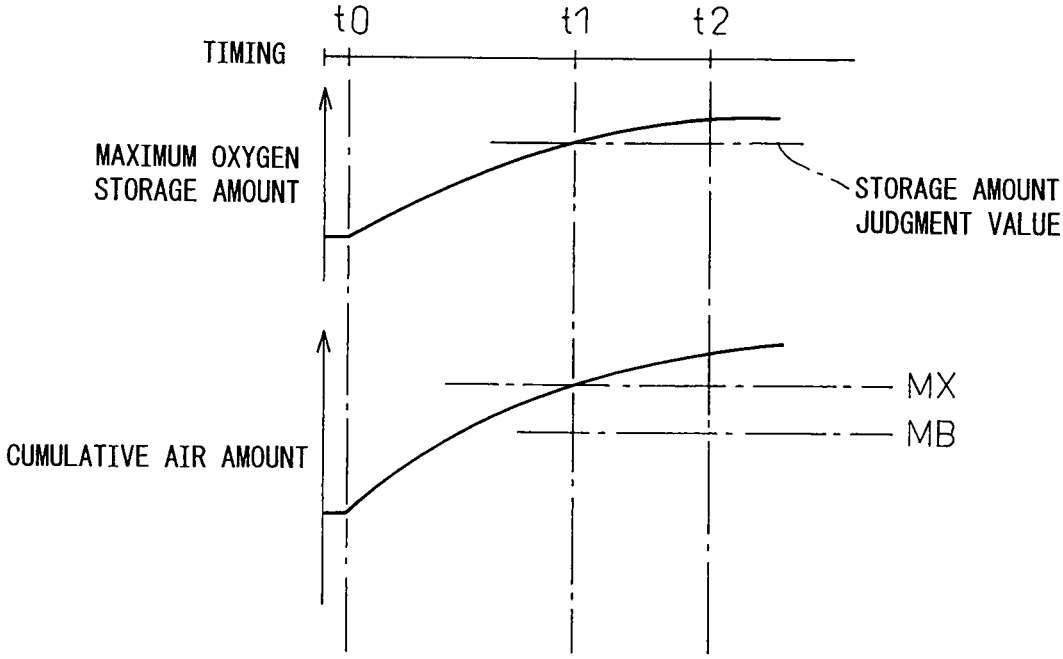
FIG. 9 is a time chart of a third operational control in Embodiment 1.

FIG. 9 shows a time chart of the third operational control in the present embodiment. At the timing t0, the internal combustion engine is started up. At the timing t2, the maximum oxygen storage amount of the three-way catalyst 20 reaches the steady state. At the timing t2, the warmup operation is ended. The maximum oxygen storage amount becomes larger as the exhaust treatment device rises in temperature. In the third operational control, as the end operating state for obtaining the output value of the air flowmeter, the storage amount judgment value is determined. At the timing t1, the maximum oxygen storage amount of the three-way catalyst 20 reaches the storage amount judgment value. The period from the timing t0 to the timing t1 corresponds to the transition period for obtaining the output value of the air flow detector. In the same way as the first and the second operational control, the cumulative air amount MX in the period from the time of startup of the internal combustion engine to the time when the maximum oxygen storage amount reaches the storage amount judgment value is calculated from the output value of the air flowmeter.

Next, in the same way as the first operational control and the second operational control, the reference intake air amount MB corresponding to the storage amount judgment, value of the maximum oxygen storage amount is detected. It is possible to estimate the maximum oxygen storage amount at the time of startup and change the reference intake air amount MB. The smaller the maximum oxygen storage amount at the time of startup, the larger the reference intake air amount MB. Alternatively, as the reference intake air amount MB, a predetermined value may be employed.

In the third operational control as well, the cumulative air amount MX and reference intake air amount MB may be used to precisely calculate the correction value (MX/MB) of the air flowmeter.

In the above embodiment, the time of startup of the engine is employed as the initial operating state and the total amount of intake air until the devices reach the temperature or other judgment value is calculated, but the invention is not limited to this. It is also possible to determine any transition period and calculate the total amount of intake air in the period from the time of startup of the internal combustion engine to the time of the end of the warmup operation where the steady state is reached.

For example, the time when the temperature of the engine cooling water or exhaust treatment device etc. after the internal combustion engine is started up reaches a predetermined temperature may also be used as the initial operating state of the transition period. The time when the maximum oxygen storage amount of the exhaust treatment device reaches a predetermined amount after the internal combustion engine starts up may also be used as the initial operating state of the transition period. Alternatively, the time after the elapse of a predetermined time after the internal combustion engine starts up may also be used as the initial operating state of the transition period. Alternatively, the time when the warmup operation of the devices ends may also be used as the end operating state of the transition period.

Further, if the correction value for correcting the output value of an air flow detector is calculated based on the total amount of intake air which is calculated from the output value of the air flow detector and on the reference intake air amount, any correction value may be employed. For example, it is also possible to use the difference between the calculated total amount of intake air and reference intake air amount as the basis to calculate the correction value and to subtract this correction value from the output value of the air flow detector.

In the above embodiment, the mode of changing the reference intake air amount in accordance with the initial operating state for obtaining the output value of an air flow detector is explained, but the invention is not limited to this. The end operating state for obtaining the output value of the air flow detector can also be changed. For example, the temperature judgment value of the engine cooling water may also be changed in accordance with the temperature of the engine cooling water at the time of startup. Control may be performed to lower the temperature judgment value of the engine cooling water the lower the temperature of the engine cooling water at the time of startup. By this control as well, it is possible to more precisely calculate the correction value of the air flowmeter.

In this regard, at the time of startup of the internal combustion engine, sometimes the temperature of the engine body is close to the steady state temperature. For example, when stopping the internal combustion engine and restarting the internal combustion engine before its temperature has not sufficiently fallen, the temperature of the engine body is high. If detecting the temperature of the engine cooling water as the amount of heat which is discharged from the engine body and determining the transition period, sometimes the temperature of the engine cooling water is already close to the steady state. In this case, if calculating the correction value of the air flowmeter, sometimes the cumulative air amount ends up becoming smaller and the precision ends up falling.

Therefore, when the temperature of the engine body at the time of startup is the predetermined temperature or more, it is possible to perform control to prohibit calculation of the correction value of the air flowmeter. As the condition for prohibiting the calculation of the correction value of the air flowmeter, for example, the temperature of the engine cooling water at the time of startup being higher than a predetermined temperature judgment value, the temperature of the exhaust treatment device at the time of startup being higher than a predetermined temperature judgment value, the maximum oxygen storage amount of the exhaust treatment device at the time of startup being larger than the judgment value of the predetermined oxygen storage amount, the elapsed time from when the internal combustion engine stopped the previous time being smaller than a predetermined value, etc. may be employed. Alternatively, when comparing the temperature of a predetermined device, if the temperature of the predetermined device is higher than that temperature plus a predetermined temperature, it is possible to perform control to prohibit the calculation of the correction value of the air flowmeter.

In the present embodiment, the example was explained of calibrating the air flowmeter in the period when starting up the internal combustion engine and in the state where the engine body is idling, that is, while the no-load state is being maintained, but the invention is not limited to this. The engine body may also have a load. For example, when the internal combustion engine is arranged in an automobile, the automobile may be driven. In this case as well, it is possible to calculate the correction value of the air flowmeter by this control.

Further, the operating state for determining the transition period for obtaining the output value of the air flowmeter is not limited to the temperature of the engine cooling water, the temperature of the exhaust treatment device, and the maximum oxygen storage amount of the exhaust treatment device. It is also possible to employ any parameter corresponding to the amount of heat generation of the internal combustion engine. For example, it is also possible to directly detect the temperature of the engine body or detect the temperature of the lubrication oil of the engine body so as to determine the transition period.

In the present embodiment, as the total amount of intake air in the transition period, the cumulative air amount obtained by cumulatively adding the amounts of air obtained by multiplying the air flow amount Vg with the time interval $\Delta t$ is calculated, but the invention is not limited to this. It is possible to calculate the total amount of intake air by any control using the output value of the air flow detector. For example, it is also possible to calculate the average value of the amounts of flow of air in the transition period and multiply the average value of the amounts of flow of air with the time of the transition period to calculate the total amount of intake air.

In the present embodiment, the explanation was given using as an example an engine fueled by gasoline, but the invention is not limited to this. It is also possible to employ the present invention in a diesel engine fueled by diesel fuel or other internal combustion engine.

Embodiment 2

Figure 10:
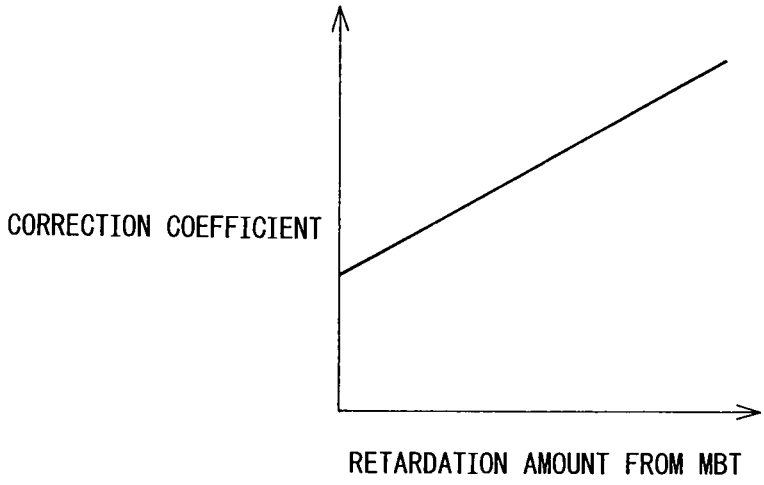
FIG. 10 is a graph of a correction coefficient of a cumulative air amount for an ignition timing in a first operational control in Embodiment 2.
Figure 11:
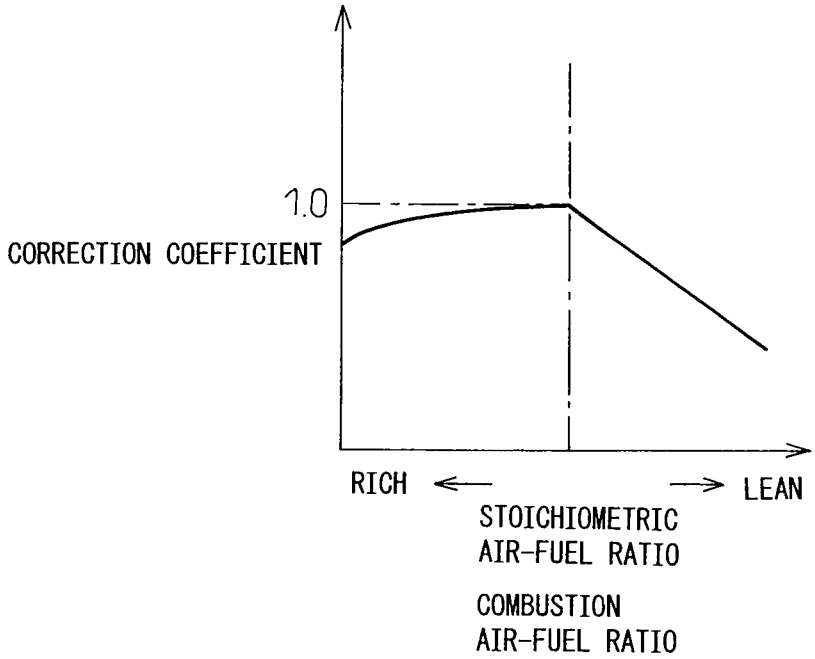
FIG. 11 is a graph of a correction coefficient of a cumulative air amount for a combustion air-fuel ratio in a second operational control in Embodiment 2.
Figure 12:
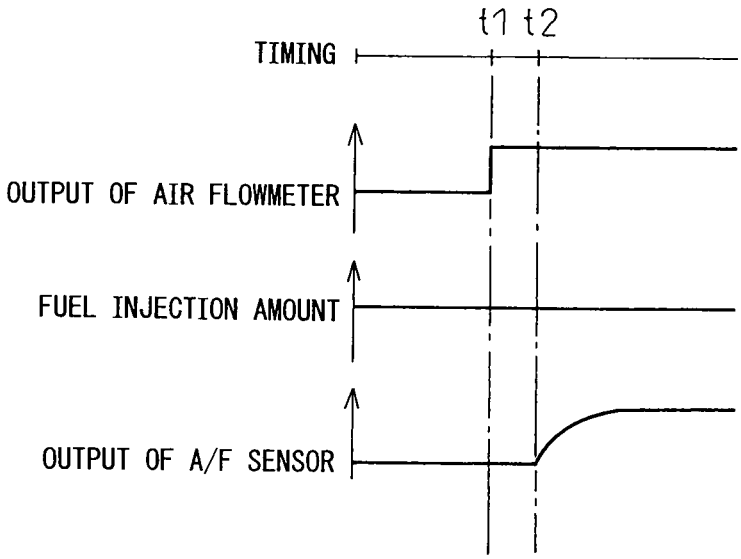
FIG. 12 is a time chart which explains a time lag of output of an air-fuel ratio sensor of a third operational control in Embodiment 2.

Referring to FIG. 10 to FIG. 12, the control system of an internal combustion engine in Embodiment 2 will be explained. The hardware configuration of the internal combustion engine in the present embodiment is similar to that of Embodiment 1 (see FIG. 1). In the present embodiment, when calculating the total amount of intake air from the output value of the air flowmeter, the output value of the air flowmeter is further corrected in accordance with the operating state of the internal combustion engine.

In the first operational control of the internal combustion engine in the present embodiment, the amount of retardation of the ignition timing of the air-fuel mixture in the combustion chambers is detected. When calculating the cumulative air amount from the output value of the air flowmeter, the output value of the air flowmeter is corrected to become larger the larger the amount of retardation of the ignition timing in the combustion chambers.

The internal combustion engine changes in output torque depending on the ignition timings in the combustion chambers 5. The output torque changes depending on the position of a piston 3 at the time of ignition by a spark plug 10. The internal combustion engine has an ignition timing MBT where the output torque becomes maximum (minimum advance for best torque). For example, it is possible to increase the output torque by ignition at a timing slightly before compression top dead center (TDC) where the piston 3 is at the topmost position.

FIG. 10 shows a graph of the correction coefficient when calculating the cumulative air amount of the first operational control in the present embodiment. The abscissa shows the amount of retardation from the ignition timing MBT. In general, by retarding the ignition from the ignition timing MBT, the output torque becomes smaller, while the temperature of the exhaust gas rises. The ordinate shows the correction coefficient $\alpha$ at the time of calculation of the cumulative air amount from the output value of the air flowmeter.

In control of the internal combustion engine, sometimes the ignition timing is retarded to make the temperature of the exhaust gas rise. For example, a three-way catalyst 20 or other exhaust treatment device has an activation temperature where the purification performance of exhaust gas reaches a predetermined ability. At the time of startup of the internal combustion engine etc., the exhaust treatment device is low in temperature and less than the activation temperature. For this reason, at the time of startup of the internal combustion engine, sometimes the temperature of the exhaust treatment device is made to quickly reach the activation temperature by making the temperature of the exhaust gas rise. In this case, the ignition timing is retarded.

If retarding the ignition timing, the amount of heat which is generated at the engine body becomes larger. When detecting the cumulative air amount MX, the amount of heat which is generated at the engine body becomes larger and the transition period ends in a shorter time.

In the control system of the present embodiment, the following formula is used to calculate the cumulative air amount MX.

$$MX(k)=MX(k-1)+Vg(k)\times\alpha\times\Delta t \quad (2)$$

Here, the constant k is a natural number and shows the number of times of calculations when calculating the cumulative air amount. The constant $\alpha$ is a correction coefficient for the air amount of flow Vg(k) based on the output value of the air flowmeter.

The relationship between the ignition timing and the correction coefficient shown in FIG. 10 is, for example, stored in the ROM 34 of the electronic control unit 31.

At different timings in the period of calculating the cumulative air amount MX, it is possible to detect the amount of retardation from the ignition timing MBT and determine the correction coefficient $\alpha$ in accordance with the ignition timing MBT. The larger the amount of retardation of the ignition timing, the larger the correction coefficient $\alpha$ is made. The larger the amount of retardation of the ignition timing, the larger the amount of air at the time interval $\Delta t$ ($Vg(k)\times\alpha\times\Delta t$) that is calculated.

In this way, when calculating the total amount of intake air in the transition period, it is possible to make corrections so that the larger the amount of retardation of the ignition timing of the fuel in a combustion chamber, the larger the total amount of intake air becomes, so it is possible to more precisely calculate the correction value of the air flowmeter.

Next, second operational control of the present embodiment will be explained. In the second operational control, the air-fuel ratio at the time when fuel is burned in a combustion chamber (combustion air-fuel ratio) is used as the basis to correct the air amount. The combustion air-fuel ratio can, for example, be detected by the air-fuel ratio sensor 79 which is attached to the engine exhaust passage (see FIG. 1).

FIG. 11 shows a graph of the correction coefficient corresponding to the combustion air-fuel ratio. FIG. 11 shows the correction coefficient $\alpha$ of formula (2). When the combustion air-fuel ratio is substantially the stoichiometric air-fuel ratio, the correction coefficient $\alpha$ is 1.0. In the state where the combustion air-fuel ratio is larger than the stoichiometric air-fuel ratio, that is, in the region where the combustion air-fuel ratio is lean, the correction coefficient $\alpha$ is made smaller the larger the combustion air-fuel ratio. In the state where the combustion air-fuel ratio is less than the stoichiometric air-fuel ratio, that is, in the region where the combustion air-fuel ratio is rich, the correction coefficient $\alpha$ is made smaller the smaller the combustion air-fuel ratio becomes.

In the region where the combustion air-fuel ratio is lean, the amount of air becomes in excess to the amount of fuel which is fed. The larger the combustion air-fuel ratio becomes, the smaller the amount of heat which is exhausted into the engine exhaust passage. For this reason, the correction coefficient $\alpha$ is determined so that the total amount of intake air which is calculated becomes smaller the leaner the combustion air-fuel ratio becomes.

On the other hand, in the region where the combustion air-fuel ratio is rich, the oxygen which is contained in the intake air is insufficient for the fed fuel. The greater the amount of fuel which is fed to the intake air amount, the more the temperature of the exhaust gas falls. The smaller the combustion air-fuel ratio becomes, the smaller the amount of heat which is exhausted into the engine exhaust passage. For this reason, the correction coefficient $\alpha$ is determined so that the total amount of intake air which is calculated becomes smaller the richer the combustion air-fuel ratio becomes.

By employing this correction coefficient α and calculating the total amount of intake air, it is possible to more precisely calculate the correction value of the air flowmeter.

Next, third operational control of the present embodiment will be explained. In the third operational control, in addition to the second operational control, the time lag of the detection of the combustion air-fuel ratio is considered. Referring to FIG. 1, the air flowmeter 16 is arranged in the engine intake passage, while the air-fuel ratio sensor 79 is arranged in the engine exhaust passage. The air passes through the engine intake passage and is burned in the combustion chamber 5, then is discharged to the engine exhaust passage. For this reason, a predetermined time is required until the air whose amount of flow is detected by the air flowmeter 16 reaches the air-fuel ratio sensor 79.

FIG. 12 is a time chart which explains the time lag in the output of the air-fuel ratio sensor. At the timing t1, the output value of the air flowmeter increases. That is, the amount of flow of the intake air increases. The fuel injection amounts in the combustion chambers at this time are substantially constant from the timing t1 to the timing t2. The air which is increased in amount of flow is burned in the combustion chambers 5, then is discharged into the engine exhaust passage. The output value of the air-fuel ratio sensor 79 rises at the timing t2 delayed from the timing t1. Due to such transport of air, this is output from the air-fuel ratio sensor 79 after the retardation time (t2–t1) from the output of the air flowmeter 16.

In the third operational control, in the formula (2), a detection value of a predetermined time before is employed as the value of the air flow amount Vg which is detected by the output value of the air flowmeter. That is, the cumulative air amount MX(k) at the time of the k-th calculation becomes the following formula (3).

$$MX(k)=MX(k-1)+Vg(k-p)\times\alpha\times\Delta t \quad (3)$$

Here, the constant p is a natural number, while the variable Vg(k–p) shows the air flow amount which is detected a predetermined number of times before. The constant p corresponds to the retardation time (t2–t1) of the output of the air-fuel ratio sensor. The constant p can be determined based on the positions of the air flowmeter and the air-fuel ratio sensor etc. Note that when the number of times (k–p) when detecting the amount of flow Vg of air of the engine intake passage is smaller than zero, it is possible to employ the amount of flow Vg of air based on the current output value of the air flowmeter.

In the third operational control, the air flow amount Vg of the air flowmeter which is detected a predetermined time before is employed as the current air flow amount. When repeating calculation to calculate the cumulative air amount MX, the detection value of the air flow amount a predetermined time before is employed. By performing this control, it is possible to more precisely calculate the cumulative air amount. More precisely, it is possible to calculate the correction value for the output value of the air flowmeter.

Furthermore, sometimes the air-fuel ratio sensor itself has a response delay. That is, sometimes a predetermined time is required from when the predetermined exhaust gas reaches the air-fuel ratio sensor to when the air-fuel ratio of the exhaust gas is detected. In this case as well, it is possible to employ the air flow amount Vg(k–p) which was detected a predetermined time before so as to more precisely calculate the cumulative air amount.

Next, fourth operational control in the present embodiment will be explained. When the internal combustion engine has an exhaust gas recirculation passage, it is possible to control it so that the larger the recirculation rate of the exhaust gas, the smaller the correction coefficient α in the formula (2) is made. It is possible to control it so that the larger the amount of flow of the exhaust gas which is recirculated from the engine exhaust passage to the engine intake passage, the smaller the correction coefficient is made. The higher the recirculation rate, the lower the temperature of the exhaust gas when burning the fuel. That is, the amount of heat which is exhausted from a combustion chamber to the engine exhaust passage becomes smaller. For this reason, by making the correction coefficient α smaller the larger the recirculation rate, it is possible to precisely calculate the total amount of intake air. More precisely, it is possible to calculate the correction value for the output value of the air flowmeter.

In particular, when the internal combustion engine is a diesel engine etc., sometimes the recirculation passage of the exhaust gas has a cooling device for the recirculated gas arranged in it. In this case, the exhaust gas is cooled until reaching the combustion chambers. The combustion temperature in the combustion chambers therefore falls. For this reason, in an internal combustion engine in which a cooling device is arranged in the recirculation passage, it is possible to more precisely calculate the total amount of intake air.

The rest of the configuration, action, and effects are similar to Embodiment 1, so the explanations will not be repeated here.

The above embodiments may be suitably combined. In the above figures, the same or corresponding parts are assigned the same reference notations. Note that the above embodiments are illustrations and do not limit the invention. Further, the embodiments include changes shown in the claims.

REFERENCE SIGNS LIST

1 engine body
5 combustion chamber
10 spark plug
11 fuel injector
15 intake duct
16 air flowmeter
17 step motor
18 throttle valve
20 three-way catalyst
21 catalyst converter
26 EGR gas conduit
27 EGR control valve
31 electronic control unit
51 radiator
58 water temperature sensor
78 temperature sensor
79, 80 air-fuel ratio sensor

The invention claimed is:

1. A control system of an internal combustion engine which is provided with an air flow detector which is arranged in an engine intake passage and in which, an initial operating state and an end operating state for obtaining the output value of an air flow detector are determined in the period from the time of startup of the internal combustion engine to when the warmup operation ends, in transition period from the initial operating state to the end operating state, the total amount of intake air in said transition period is calculated from a detected output value of the air flow detector, and the calculated total amount of intake air and reference intake air amount corresponding to said transition period are used as the basis to correct the output value of the air flow detector.

2. A control system of an internal combustion engine as set forth in claim 1, wherein the system is provided with a coolant temperature detector which detects the temperature of a coolant of an engine cooling system and said transition period includes a period in which the temperature of the coolant of the engine cooling system reaches the temperature judgment value from the predetermined initial operating state.

3. A control system of an internal combustion engine as set forth in claim 2, wherein the initial operating state is the state at the time of startup of the internal combustion engine and the system detects the temperature of the coolant at the time of startup of the internal combustion engine and increases said reference intake air amount the lower the temperature of the coolant at the time of startup.

4. A control system of an internal combustion engine as set forth in claim 1, wherein the system is a control system of an internal combustion engine in which an exhaust treatment device is arranged in engine exhaust passage, the system is provided with a temperature detector which detects a temperature of the exhaust treatment device, and said transition period includes a period in which the temperature of the exhaust treatment device reaches the temperature judgment value from the predetermined initial operating state.

5. A control system of an internal combustion engine as set forth in claim 4, wherein the initial operating state is the state at the time of startup of the internal combustion engine and the system detects the temperature of the exhaust treatment device at the time of startup of the internal combustion engine and increases said reference intake air amount the lower the temperature of the exhaust treatment device at the time of startup.

6. A control system of an internal combustion engine as set forth in claim 1, wherein the system is a control system of an internal combustion engine in which an exhaust treatment device is arranged in engine exhaust passage, the system is provided with a storage estimating device which estimates the maximum oxygen storage amount of the exhaust treatment device, and said transition period includes a period in which the maximum oxygen storage amount of the exhaust treatment device reaches the storage amount judgment value from the predetermined initial operating state.

7. A control system of an internal combustion engine as set forth in claim 6, wherein the initial operating state is the state at the time of startup of the internal combustion engine and the system estimates the maximum oxygen storage amount at the time of startup of the internal combustion engine and increases said reference intake air amount the smaller the maximum oxygen storage amount at the time of startup.

8. A control system of an internal combustion engine as set forth in claim 1, wherein when calculating the total amount of intake air in said transition period, the system detects the amount of retardation of the ignition timing in the combustion chamber and makes correction so that the total amount of intake air becomes larger the larger the amount of retardation of the ignition timing.

9. A control system of an internal combustion engine as set forth in claim 1, wherein, when calculating the total amount of intake air in said transition period, the system estimates the air-fuel ratio at the time of combustion in the combustion chamber and makes correction so that the total amount of intake air becomes smaller the larger the air-fuel ratio at the time of combustion in the region in which the air-fuel ratio at the time of combustion becomes lean.

10. A control system of an internal combustion engine as set forth in claim 1, wherein, when calculating the total amount of intake air in said transition period, the system estimates the air-fuel ratio at the time of combustion in the combustion chamber and makes correction so that the total amount of intake air becomes smaller the smaller the air-fuel ratio at the time of combustion in the region in which the air-fuel ratio at the time of combustion becomes rich.

11. A control system of an internal combustion engine as set forth in claim 1, wherein the system is a control system of an internal combustion engine which has a recirculation passage which causes exhaust gas to recirculate from the engine exhaust passage to the engine intake passage and when calculating the total amount of intake air in said transition period, the system makes corrections so that the smaller the total amount of intake air becomes smaller the larger the recirculation rate of the exhaust gas.

* * * * *